US005419046A

United States Patent [19]

Mayo, Jr.

[11] Patent Number: 5,419,046

[45] Date of Patent: May 30, 1995

[54] CHROME PLATE REMOVER

[76] Inventor: Ronald A. Mayo, Jr., 226 9th St., Brookhaven, Pa. 19015-3005

[21] Appl. No.: 223,651

[22] Filed: Apr. 5, 1994

[51] Int. Cl.[6] ..... B08B 1/04; B26B 3/00

[52] U.S. Cl. ..... 30/169; 15/236.07

[58] Field of Search ..... 30/169, 90.9; 15/104.04, 236.01, 236.07, 236.1

[56] References Cited

U.S. PATENT DOCUMENTS 2,410,420 11/1946 Bennett ..... 15/236.01
3,089,237 5/1963 Norton ..... 30/90.9 X
3,486,183 12/1969 Caprioli ..... 15/236.07 X

*Primary Examiner*—Douglas D. Watts

[57] ABSTRACT

The present invention is designed to easily and quickly remove chrome plating from the end of a copper or brass tube to prepare the tube for soldering. The device resembles a conventional tubing cutter with a special angled peeling blade in the position normally occupied by the disc cutter of such a tool. Basically it comprises a hand-held C-shaped, rigid frame having a pair of tubing-supporting wheels or rollers positioned in a rigid support block vertically adjustable within such frame. Mounted at the top of the frame and angled downwardly therein is a spring-loaded flat tungsten carbide peeling blade. When the tubing end to be treated is inserted in the frame with the tube riding on the wheels or rollers and the block supporting such rollers is moved up to engage the tubing end with the peeling blade, rotation of the tubing in a clockwise direction initiates a slicing cut in the chrome plating on such tube end. Continued rotation with increasing height adjustment of such rollers causes the plating to be shaved off the tube metal until such tube metal is exposed free of such plating. A chip slot in the upper portion of such frame permits the peeled chrome plate to exit the device. The peeling blade is usually about ½ inch in width giving a chrome-free end of the same dimension.

4 Claims, 4 Drawing Sheets

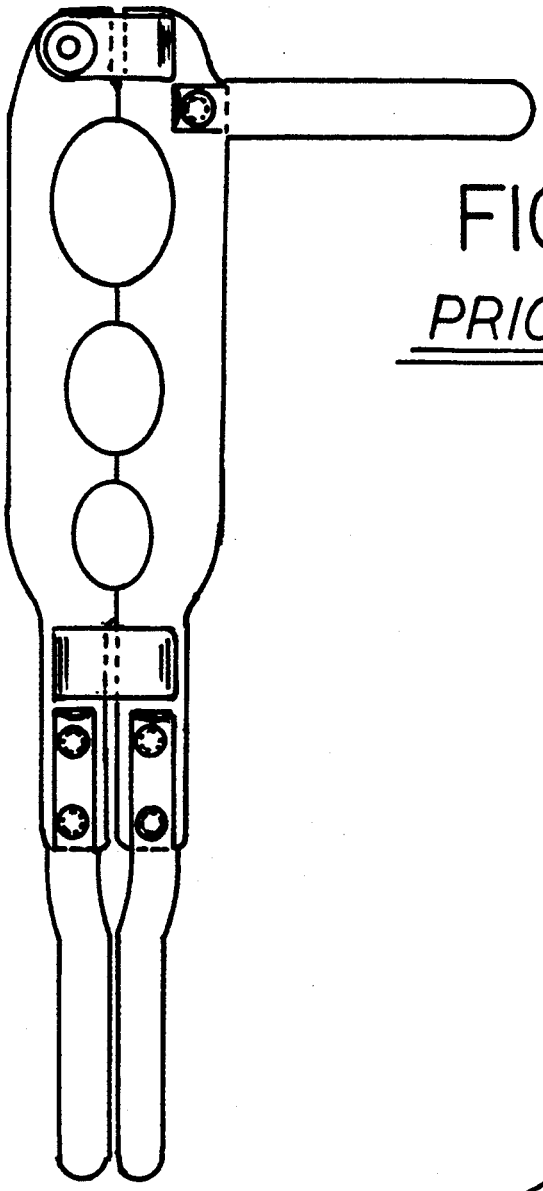
FIG 1
PRIOR ART
FIG 2
PRIOR ART
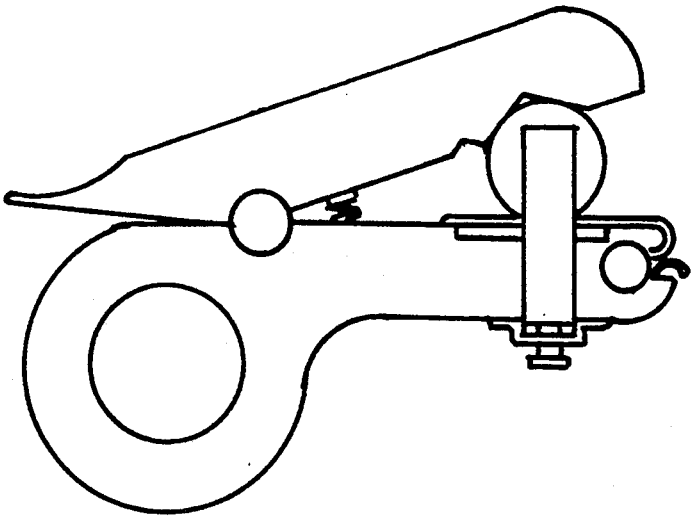

FIG 3
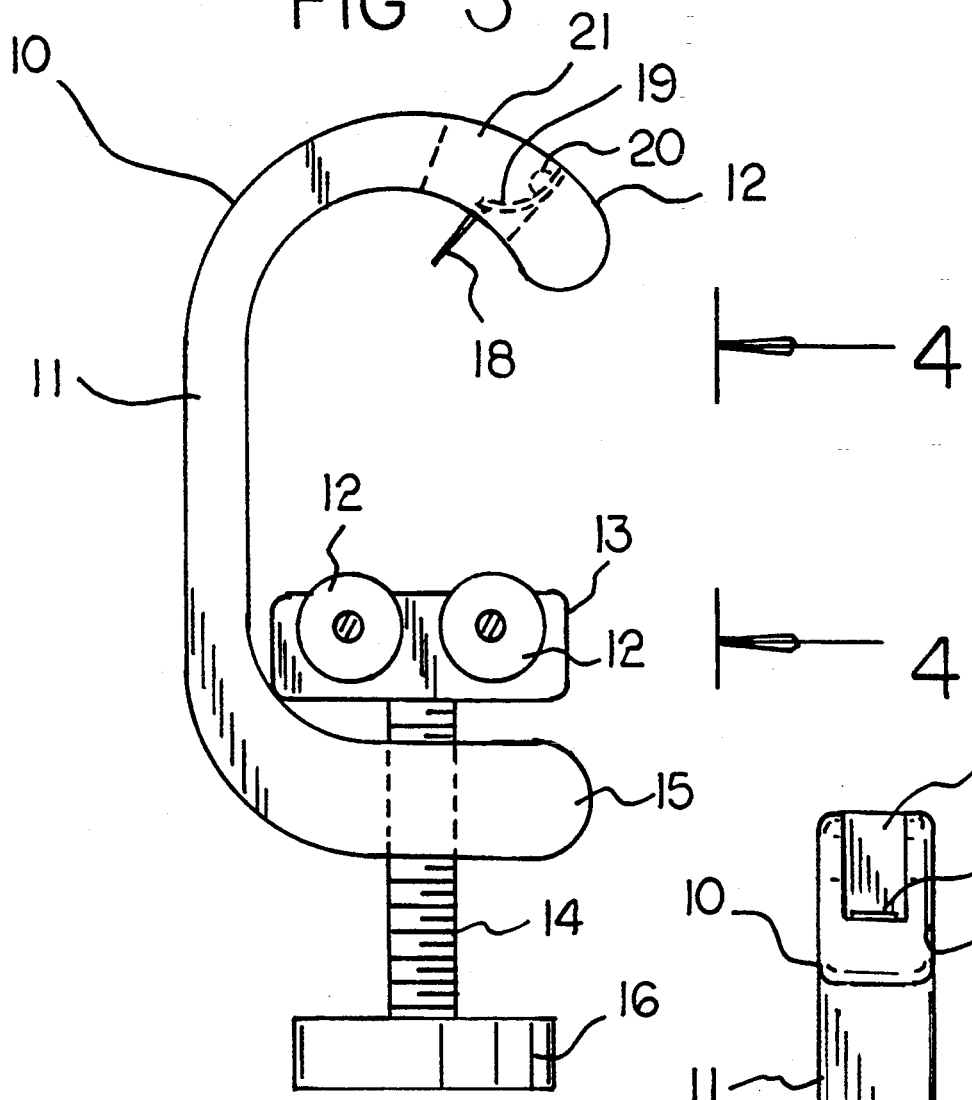
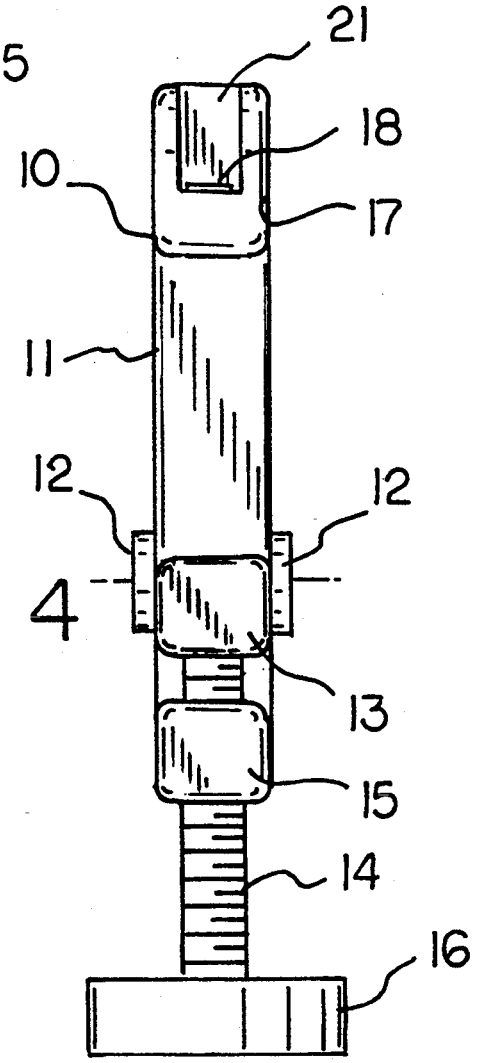
FIG 4

FIG 7
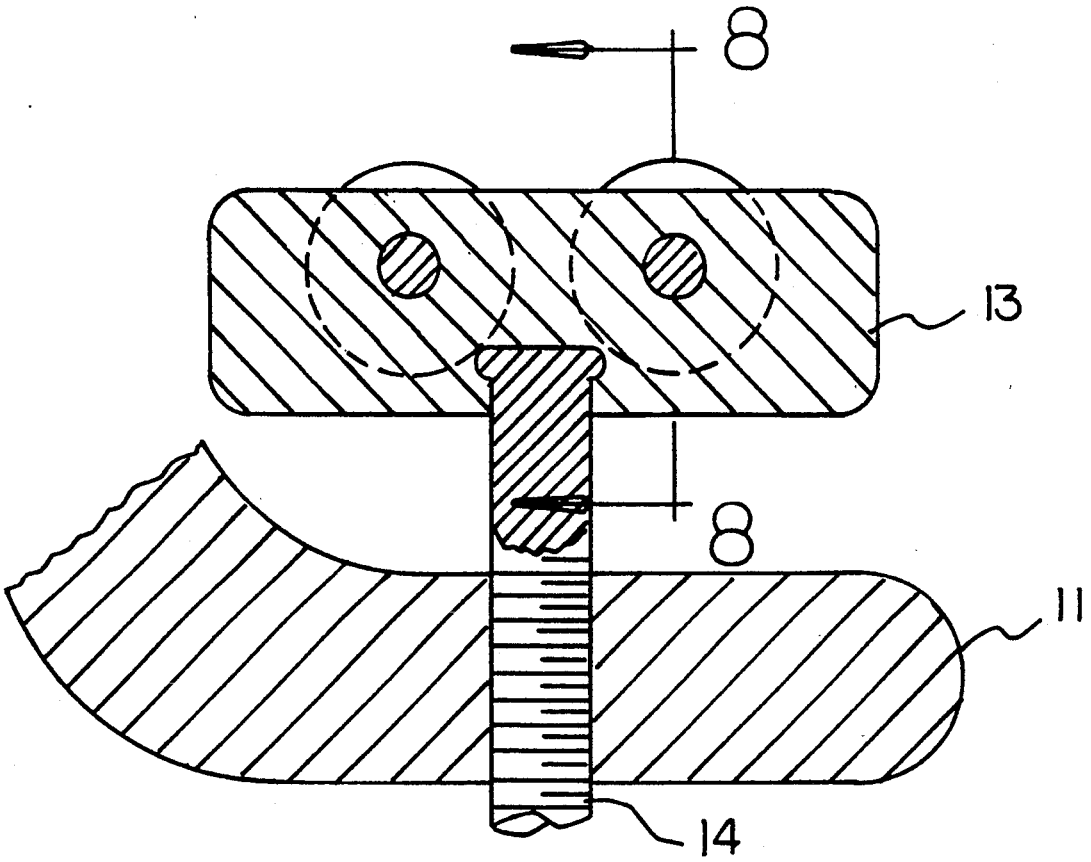
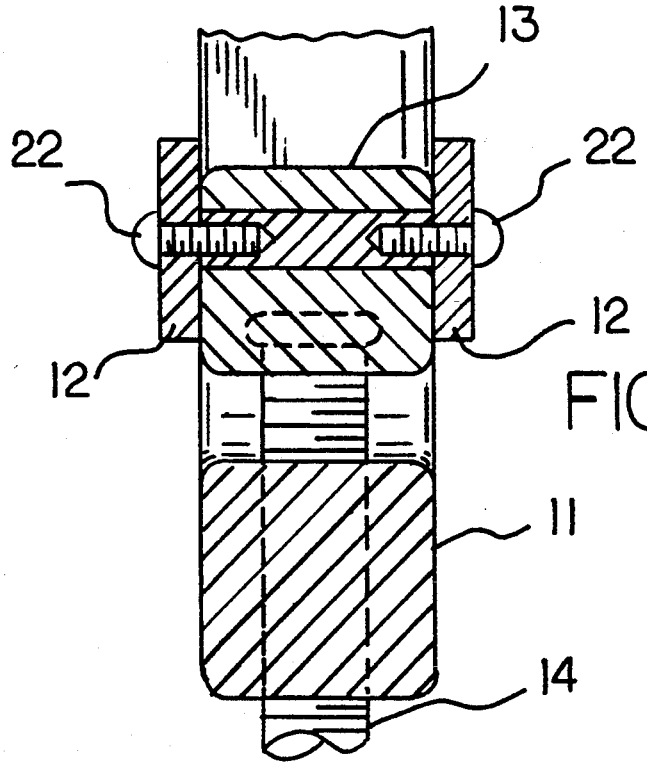
FIG 8

CHROME PLATE REMOVER

BACKGROUND OF THE INVENTION

1. Field of the Invention

The present invention relates to pipe cleaning tools and more particularly pertains to such a tool which may be used to remove chrome plate from the ends of plated brass or copper tubing.

2. Description of the Prior Art

The use of tubing cleaners is known in the prior art. More specifically, tools heretofore devised and utilized for the purpose of cleaning pipe or tubing are known to consist basically of familiar, expected and obvious structural configurations, notwithstanding the myriad of designs encompassed by the crowded prior art which have been developed for the fulfillment of countless objectives and requirements. Usually such tools utilize abrasives, wire brushes or the like which are time consuming, especially on very hard chrome plate. Typical tools of this type are illustrated in U.S. Pat. Nos. 3,486,183; 3,638,367; 4,133,070; 4,750,249; and 5,146,717.

In this respect, the device according to the present invention substantially departs from the conventional concepts and designs of the prior art, and in so doing provides an apparatus primarily developed for the purpose of reeling chrome plate from the ends of brass or copper plated tubes to prepare such tubes to receive solder.

Therefore, it can be appreciated that there exists a continuing need for new and improved tubing cleaners which can be used to remove chrome plate. In this regard, the present invention substantially fulfills this need.

SUMMARY OF THE INVENTION

In view of the foregoing disadvantages inherent in the known types of tools now present in the prior art, the present invention provides an improved construction wherein the same can be utilized to easily and quickly clean chrome plate from brass or copper tubing. As such, the general purpose of the present invention, which will be described subsequently in greater detail, is to provide a new and improved device which has all the advantages of the prior art tools and none of the disadvantages.

To attain this, the present invention is designed to easily and quickly remove chrome plating from the end of a copper or brass tube to prepare the tube for soldering. The device resembles a conventional tubing cutter with a special angled peeling blade in the position normally occupied by the disc cutter of such a tool. Basically it comprises a hand-held C-shaped, rigid frame having a pair of tubing-supporting wheels or rollers positioned in a rigid support block vertically adjustable within such frame. Mounted at the top of the frame and angled downwardly therein is a spring-loaded flat tungsten carbide peeling blade. When the tubing end to be treated is inserted in the frame with the tube riding on the wheels or rollers and the block supporting such rollers is moved up to engage the tubing end with the peeling blade, rotation of the tubing in a clockwise direction initiates a slicing cut in the chrome plating on such tube end. Continued rotation with increasing height adjustment of such rollers causes the plating to be shaved off the tube metal until such tube metal is exposed free of such plating. A chip slot in the upper portion of such frame permits the peeled chrome plate to exit the device. The peeling blade is usually about ½ inch in width giving a chrome-free end of the same dimension.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved device for removing chrome plating from copper or brass tubes which has all the advantages of the prior art tools and none of the disadvantages.

It is another object of the present invention to provide a new and improved chrome plate remover which may be easily and efficiently manufactured and marketed.

It is a further object of the present invention to provide a new and improved chrome plate remover which is of a durable and reliable construction.

An even further object of the present invention is to provide a new and improved chrome plate remover which is susceptible of a low cost of manufacture with regard to both materials and labor, and which accordingly is then susceptible of low prices of sale to the consuming public, thereby making such devices economically available to the buying public.

Still another object of the present invention is to provide a new and improved hand-held chrome plate remover.

Yet another object of the present invention is to provide a new and improved chrome plate remover which is particularly designed to clean chrome plate off the ends of plated copper or brass tubing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front plan view of a prior art pipe scraper.

FIG. 2 is a side plan view of a prior art tool for treating the surface of a tube.

FIG. 3 is a plan view of the present invention.

FIG. 4 is a front plan view on line 4—4 of FIG. 3.

FIG. 7 is a side sectional view of the base of the device of FIG. 3.

FIG. 8 is a sectional view on line 8—8 of FIG. 7.

DESCRIPTION OF THE PREFERRED EMBODIMENT

Figure 5:
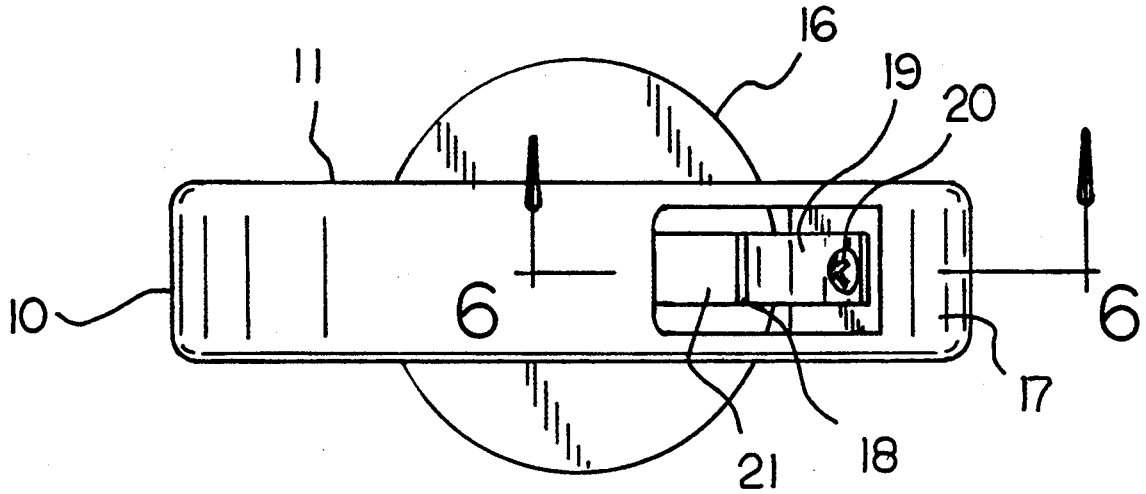
FIG. 5 is a top plan view of the device of FIG. 3.

FIGS. 1 and 2 illustrate prior art tools for treating the outside surface of a pipe or tube with the device of FIG. 1 applying the scraping pressure of a pair of jaws while that of FIG. 2 provides for rotating an abrasive surface over the tube or pipe.

With reference now to FIG. 3 of the drawings, a new and improved chrome plate removal device embodying the principles and concepts of the present invention and generally designated by the reference numeral 10 will be described.

More specifically, it will be noted that the device 10 is similar in general appearance to a conventional tubing cutter in that it comprises a C-shaped rigid support frame 11 (intended to be hand-held), with a pair of tubing support rollers 12 mounted on a vertically adjustable block 13 within frame 11. A threaded shaft 14 extends through the base 15 of frame 11 and is secured at its upper end to block 13. An adjusting handle knob 16 is affixed to the lower end of shaft 14 to permit threading block 13 up or down within frame 11. Mounted at the top 17 of frame 11 on the interior surface thereof and extending downwardly therefrom is a removable angled peeling blade 18. Blade 18 is formed of tungsten carbide and is mounted at the end of a flex spring member 19 removably held to frame 11 by a mounting screw 20. Blade 18 is positioned within an aperture 21 in frame 11 which permits chips of peeled metal to exit the frame 11.

FIGS. 4 and 5 show front and top views of the device 10 described in connection with FIG. 1.

Figure 6:
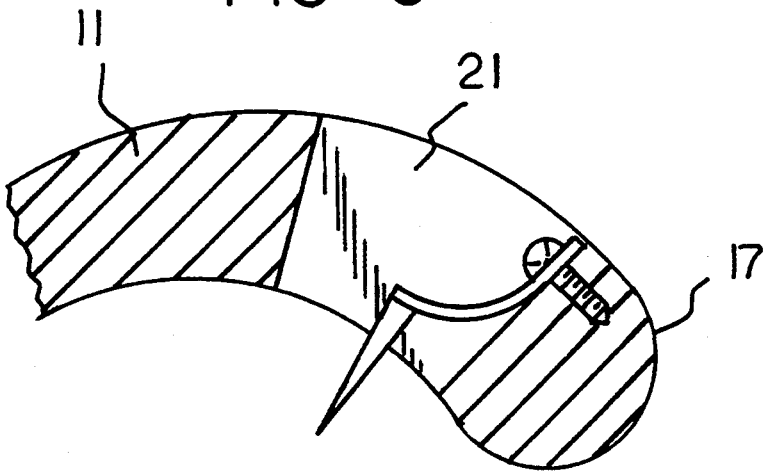
FIG. 6 is a sectional view on line 6—6 of FIG. 5.

FIG. 6 is a sectional view illustrating the mounting of peeling blade 18 on spring member 19 held to frame 11 by screw 20, and illustrating the chip removal slot or aperture 21 in the top portion 17 frame 11.

FIG. 7 is a detailed sectional view of the threadably adjustable support block 13 carrying tubing rollers 12 and movable up or down within frame 11 by threaded shaft 14.

FIG. 8 is a front sectional view of the area covered in FIG. 7 showing the threaded studs 22 holding wheels or rollers 12 to block 13.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved chrome plate remover device comprising a support frame; an angled peeling blade removably mounted within said frame; and means adjustably mounted with said support frame to support the end of a tubular workpiece in vertically adjustable rotatable engagement with said peeling blade, said support frame having an opening therethrough in a facing relationship to said means and said angled peeling blade is mounted on the end of a flex spring, said flex spring wholly secured within said opening and said peeling blade projecting from said opening, with said frame in a facing relationship to said means.

2. A device as in claim 1 wherein said angled peeling blade comprises a tungsten carbide cutter.

3. A device as in claim 1 wherein said means to support a tubular workpiece comprises a pair of vertically adjustable rollers mounted within said frame.

4. A device as in claim 3 wherein a threaded shaft engages with said frame and with a floating block and associated rollers vertically within said frame.

* * * * *